United States Patent [19]

Häfner

[11] 4,104,712

[45] Aug. 1, 1978

[54] OUTDOOR LIGHT FIXTURE

[76] Inventor: Erich Häfner, Doktorkamp 11, Leopoldshöhe, Fed. Rep. of Germany D-4811

[21] Appl. No.: 764,639

[22] Filed: Feb. 1, 1977

[30] Foreign Application Priority Data

Feb. 7, 1976 [DE] Fed. Rep. of Germany ..... 2604840

[51] Int. Cl.[2] ..... F21S 2/00

[52] U.S. Cl. ..... 362/218; 362/226; 362/294; 362/306

[58] Field of Search ..... 362/217, 218, 226, 294, 362/306

[56] References Cited

U.S. PATENT DOCUMENTS

| | | | |
|---|---|---|---|
| 1,562,875 | 11/1925 | Dubben et al. | 362/307 |
| 1,956,148 | 4/1934 | Elmendorf | 362/306 |
| 1,975,282 | 10/1934 | Mageoch | 362/306 X |
| 2,255,849 | 9/1941 | Kurth | 362/294 |
| 3,170,635 | 2/1965 | Curtin | 362/306 |
| 3,202,815 | 8/1965 | Moore | 362/294 |
| 3,311,743 | 3/1967 | Moore | 362/294 |
| 3,461,283 | 8/1969 | Hahn | 362/294 |
| 3,593,014 | 7/1971 | Vesely | 362/294 |
| 3,666,934 | 5/1972 | Moore | 362/294 |
| 4,008,654 | 2/1977 | Stahlhut et al. | 362/218 X |

*Primary Examiner*—Peter A. Nelson
*Attorney, Agent, or Firm*—Peter K. Kontler

[57] ABSTRACT

An outdoor light fixture wherein an upright column carries the bottom end wall of a one-piece hollow truncated pyramidal frame whose upper end is open and which has corner sections sloping downwardly toward the end wall. The frame is overlapped by a detachable one-piece roof-shaped cover which defines therewith a plurality of small ventilating openings surrounding the open end. The frame and the cover consist of synthetic plastic material, and each corner section has two elongated narrow legs and an inwardly extending partition which makes an acute angle with each of the respective legs. The light-transmitting panes of the fixture are inserted between the partitions of neighboring corner sections at the inner sides of the legs so that their outer sides sealingly contact the inner sides of the respective legs and their edge faces abut against the adjacent partitions. The end wall has several screens whose interstices constitute ventilating openings. All of the openings are sufficiently small to prevent nocturnal and other insects from entering the interior of the fixture when the light source which is mounted in the frame emits light and heat.

10 Claims, 6 Drawing Figures

FIG. 1
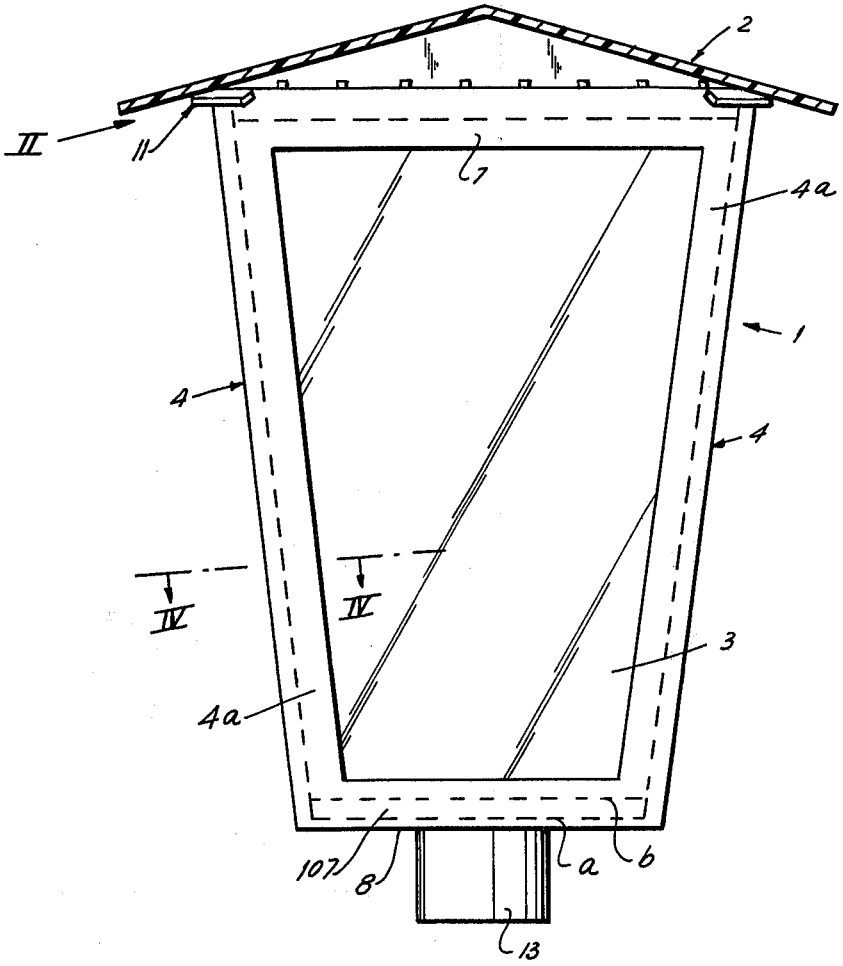
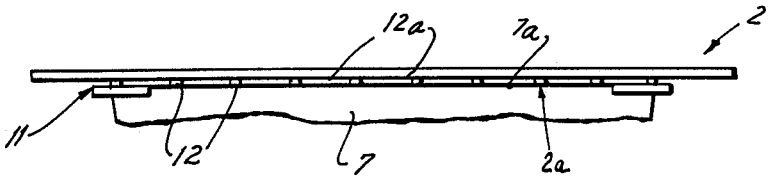
FIG. 2

OUTDOOR LIGHT FIXTURE

BACKGROUND OF THE INVENTION

The present invention relates to light fixtures, especially outdoor light fixtures. More particularly, particularly, invention relates to improvements in outdoor light fixtures of the type wherein the frame has a polygonal cross-sectional outline and tapers in a direction from the one toward the other end thereof, and wherein some or all facets of the frame contain light-transmitting panes.

As a rule, an outdoor light fixture (which can be secured to the ceiling or mounted on a wall or pole) has a polygonal frame, in most instances a frame with four or six facets. The frame must be provided with one or more openings for circulation of air in order to remove heat which is generated by one or more incandescent lamps or other light sources mounted in the interior of the fixture.

In many presently known outdoor fixtures, the frame is assembled or made of profiled metallic stock and the panes are inserted in such a way that two neighboring panes have abutting edge faces whereby one such pane holds the other in place, and vice versa. In order to prevent the panes from being forced into the interior of the frame (for example, when the panes are exposed to strong gusts of wind), the lower marginal portion of the frame is provided with deformable strips, e.g., sheet metal strips, which are bent upwardly so as to overlie the inner sides of the adjacent marginal portions of the panes. The openings for circulation of air are provided by the panes due to unavoidable tolerances in machining of the frame and/or as a result of deviations of the size of some or all panes from a predetermined size. In other words, circulation of air is assured as a result of inaccurate machining of component parts of the fixture, and the combined area of openings often varies within a wide range, particularly due to the presence of clearances between neighboring panes whose dimensions often deviate considerably from a standard size.

A drawback of outdoor fixtures wherein adequate ventilation is insured as a result of manufacturing tolerances is that the openings for inflow and/or outflow of air often are large enough to allow insects to enter the interior of the fixture. The insects are attracted by light which issues from the light source or sources as well as by heat which is generated in the interior of the fixture when the light is on. Many insects fail to find their way from the interior of the fixture and their skeletons accumulate in the fixture, either at the bottom or at the inner sides of the light-transmitting panes. This necessitates frequent cleaning of outdoor fixtures, i.e., the aforediscussed strips must be bent back to open positions in order to allow for removal of one or more panes. Repeated bending of such strips causes them to break off which necessitates repair or discarding of the fixture.

OBJECTS AND SUMMARY OF THE INVENTION

An object of the invention is to provide a light fixture, particularly an outdoor fixture, which is constructed and assembled in such a way that repeated insertion or removal of panes does not adversely affect the useful life of the fixture.

Another object of the invention is to provide an outdoor light fixture which is constructed and assembled in such a way that insects, particularly nocturnal insects which are attracted by light and/or heat when the light source in the interior of the fixture is on, cannot penetrate into the interior of the fixture in spite of the fact that the fixture can be mass-produced at a low or reasonable cost and of readily available materials.

A further object of the invention is to provide an outdoor fixture wherein the panes are accessible and removable without any deformation of portions of the frame.

An additional object of the invention is to provide an outdoor fixture of the above outlined character which is constructed and assembled in such a way that it insures adequate ventilation of its interior in spite of the fact that it prevents entry of insects.

The invention is embodied in a light fixture, particularly in an outdoor fixture, which comprises a one-piece hollow truncated pyramidal frame having an open base, an end wall located opposite the base, and sloping corner sections which extend from the base to the end wall and each of which includes two legs and a partition extending into the interior of the frame and disposed between and making an acute angle with each of the respective legs. The fixture further comprises a one-piece cover which overlies the base. Furthermore, the fixture has a plurality of first ventilating openings in the region of the end wall of the frame and a plurality of second ventilating openings in the region of the cover, and each such opening is sufficiently small to prevent insects, particularly crawling and/or flying nocturnal insects, from entering the interior of the fixture. The frame and the cover preferably consist of suitable synthetic plastic material.

The light-transmitting panes of the fixture are located in the interior of the frame between neighboring corner sections. Each pane has two sloping marginal portions one of which sealingly engages the inner side of one leg and abuts against the partition of one neigboring corner section and the other of which sealingly engages the inner side of one leg and abuts against the partition of the other neighboring corner section. The first openings may constitute the interstices of one or more filters or screens which form part of or are inserted into the bottom wall, and the second openings may constitute shallow notches or recesses in that surface of the frame which abuts against the cover and/or in that surface of the cover which abuts against the frame.

The novel features which are considered as characteristic of the invention are set forth in particular in the appended claims. The improved light fixture itself, however, both as to its construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 1 is a front elevational view of a light fixture which embodies one form of the invention, with the cover shown in section;

FIG. 2 is a fragmentary side elevational view of the light fixture, as seen in the direction of arrow II in FIG. 1;

DESCRIPTION OF THE PREFERRED EMBODIMENTS

Figure 3:
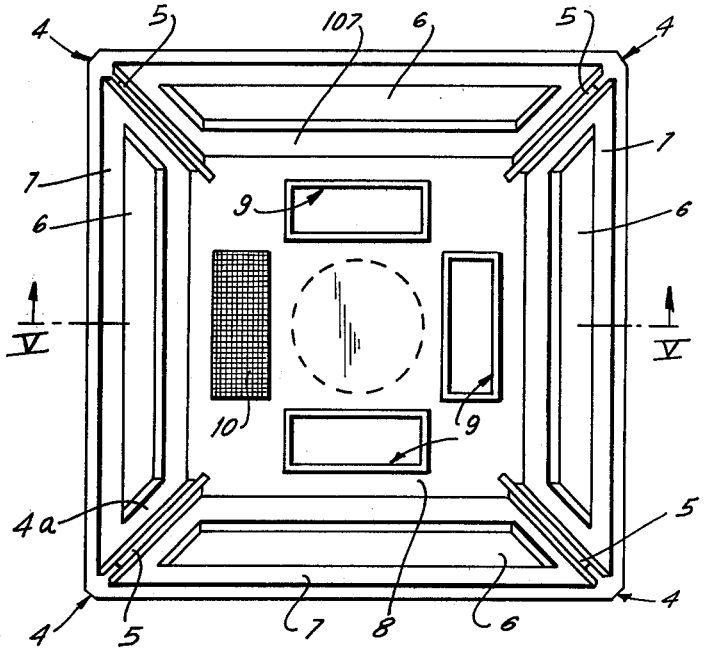
FIG. 3 is a plan view of the frame of the light fixture shown in FIG. 1.
Figure 4:
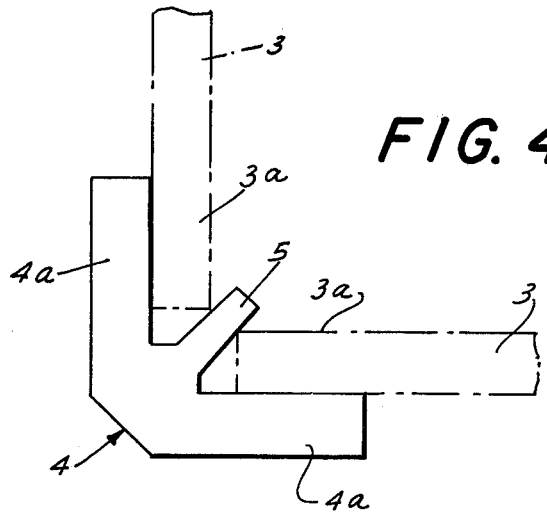
FIG. 4 is an enlarged horizontal sectional view of a corner section, as seen in the direction of arrows from the line IV—IV of FIG. 1, with the portions of two adjacent panes indicated by phantom lines.
Figure 5:
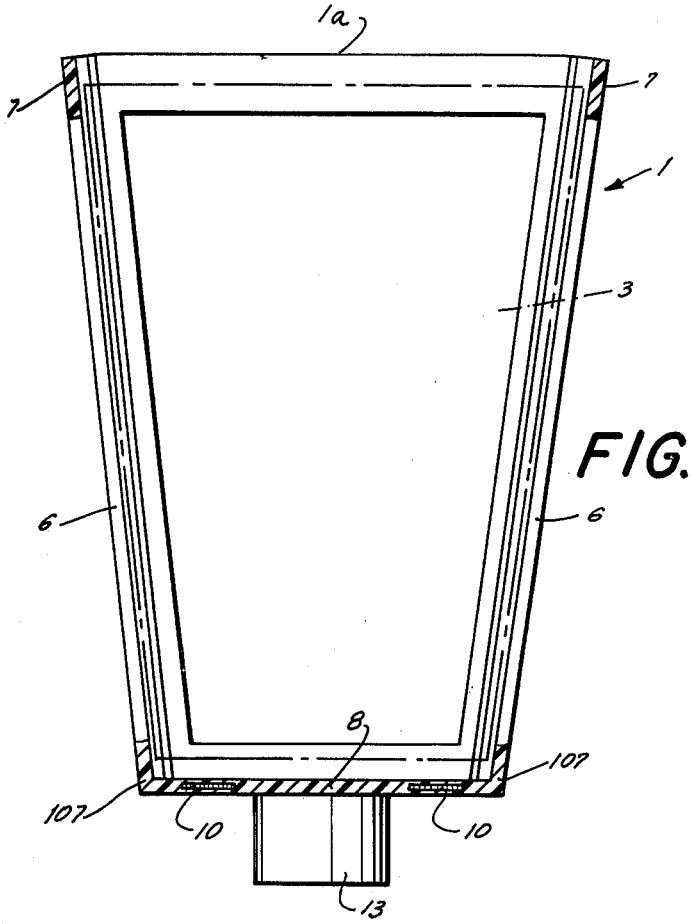
FIG. 5 is a transverse vertical sectional view of the frame, as seen in the direction of arrows from the line V—V of FIG. 3.

The outdoor light fixture which is shown in FIGS. 1 to 5 comprises a one-piece inverted hollow four-sided truncated pyramidal frame 1 having an open end 1a which constitutes the base of the pyramid, a one-piece cover 2 which resembles a hipped roof, four light-transmitting panes 3, and a hollow upright support 13 which is rigid with the central portion of the end wall 8 of frame 1 and contains conductors (not shown) connected to a socket (not shown) which is installed at the upper side of the end wall 8 and serves to receive an incandescent lamp or another suitable source of light and heat.

The end wall 8 of the frame 1 is disposed at the lower end thereof, i.e., at a level below the open end or base 1*a*, and is integral with four corner sections 4 (best shown in FIGS. 3 and 4) which slope downwardly and extend between a circumferentially complete polygonal section 107 which surrounds the end wall 8 and a similar but larger circumferentially complete polygonal section 7 which surrounds the base 1*a*. Each corner section 4 is elongated and comprises two narrow legs 4*a* which make an angle of 90° (because the frame 1 has four sides) and a partition 5 which extends into the interior of the frame 1 and makes an acute angle (45°) with each of the respective legs 4*a*.

The neighboring corner sections 4 define with the polygonal sections 7 and 107 four windows or apertures 6 which are located in front (outwardly) of the respective panes 3. Each pane has two downwardly sloping marginal portions 3*a* (see FIG. 4) the outer sides of which sealingly engage the inner sides of the respective legs 4*a* of the neighboring corner sections 4 and the edge faces of which abut against the partitions 5 of the neighboring corner sections. The width of the legs 4*a* and the height of each of the polygonal sections 7, 107 is selected in such a way that all marginal portions of each pane 3 are concealed when the panes are properly inserted into the frame 1, even if the dimensions of the panes 3 deviate from a predetermined size. FIG. 1 shows (by broken lines) that the lower edge face of the illustrated pane 3 can extend to the level *a* (e.g., into actual abutment with the upper side of the bottom wall 8) or to the level *b* (i.e., spaced apart from the bottom wall). It is important or at least desirable to insure that the outer sides of the panes 3 and the inner sides of the legs 4*a* and polygonal sections 7, 107 be flat so that the outer sides of the panes sealingly engage the respective legs and the respective portions or facets of the polygonal sections in order to avoid the development of relatively large gaps which would permit crawling and/or flying insects, especially nocturnal insects, from entering the interior of the fixture when the circuit of the light source is completed, i.e., when such source emits light and heat.

An advantage of acute angles between each partition 5 and the respective legs 4*a* is that, when a pane 3 is properly inserted into the frame 1 upon detachment of or prior to attachment of the cover 2, the panes are automatically held against any movement except upwardly toward and through the base 1*a*. In fact, the marginal portions 3*a* of the panes 3 are jammed between the respective partitions 5 and legs 4*a* so that they are not only unlikely but actually unable to move into the interior of the frame 1 even if the fixture is mounted outdoors in an area which is exposed to strong gusts of wind or other air currents. All that counts is to utilize panes which are sufficiently large to overlie the inner sides of the respective legs 4*a*, which abut against the respective partitions 5, and which are sufficiently close to the corresponding portions of the polygonal sections 7, 107 to prevent the development of relatively large cracks which would permit insects to enter into and to contaminate the interior of the fixture.

The fixture further comprises a plurality of first ventilating openings which are provided in the region of and preferably in the end wall 8 of the frame 1. As shown in FIG. 3, the end wall 8 has four equally spaced windows 9 each of which receives a screen or filter 10 (only one shown) having interstices which constitute ventilating openings and are small enough to prevent insects from passing therethrough. If the frame 1 is made of one piece of suitable synthetic plastic material, the screens 10 can be formed as integral parts of the end wall 8. The interstices or openings of the screens 10 are sufficiently small to intercept not only insects but also dust and other foreign matter or bodies; however, the combined area of openings or interstices should be large enough to allow for adequate circulation of air through the interior of the fixture, i.e., for evacuation of substantial amounts of heat energy which is radiated by the light source. The making of the frame 1 from a single piece of synthetic plastic material (e.g., by resorting to an injection molding technique) exhibits many important advantages, i.e., the frame 1 is a lightweight body, its cost is low and the screens 10 can be made as integral parts of the end wall 8. Moreover, the panes 3 (which may consist of glass or a light-transmitting synthetic plastic material) are less likely to break or chip in response to insertion into a frame wherein the sections 4, 7 and 107 consist of a synthetic plastic material, especially a slightly elastic plastic material.

The cover 2 preferably also consists of a single piece of suitable synthetic plastic material and may be separably attached to the frame 1 (in the region of the polygonal section 7) by two or more screws, bolts or other suitable fasteners, not shown. For example, the fastener means may include screws each of which extends through a hole in the roof-shaped cover 2 and into one of the four corner portions of the upper polygonal section 7. Alternatively, or in addition to the aforementioned fasteners, the cover 2 may be provided with four brackets 11 which can be snapped onto the upper end of the frame 1.

The light fixture is further formed with a plurality of ventilating openings which are disposed in the region of the roof-shaped cover 2. For example, and as shown in FIG. 2, the underside or inner surface 2*a* of the cover 2 may be formed with relatively shallow recesses or notches 12*a* alternating with short projections or lobes 12 which abut against the adjacent surface 7*a* of the polygonal section 7. The notches 12*a* constitute openings which permit atmospheric air to flow into or hot air to flow from the interior of the fixture. The notches 12*a* surround the entire open end or base 1a of the frame 1. For example, the width of notches 12*a* (as considered at right angles to the surface 7*a*) may be a very small fraction of one millimeter (e.g., 0.2 millimeter); this insures that such notches effectively prevent entry of insects into the interior of the fixture. If desired, the notches can be provided in the surface *7a* of the polygonal section 7. As mentioned above, the insects, especially nocturnal insects, seek to enter the fixture because they are attracted by light and/or heat which issues from the light source. Since the openings in the bottom wall 8 as well as those in the region of the cover 2 are too small for entry of insects, the improved fixture requires no internal cleaning at all or it must be cleaned at infrequent intervals. Furthermore, and even if it should become necessary to repeatedly remove the cover 2 in order to gain access to the light source or to the panes 3 (e.g., if one or more panes break or are so dirty at the outside that they cannot be effectively cleaned in assembled condition of the fixture), such repeated opening and closing of the cover and/or removal of panes does not reduce the useful life of the fixture since the panes can be inserted or removed without any flexing of component parts of the frame 1 beyond the elastic limit.

Figure 6:
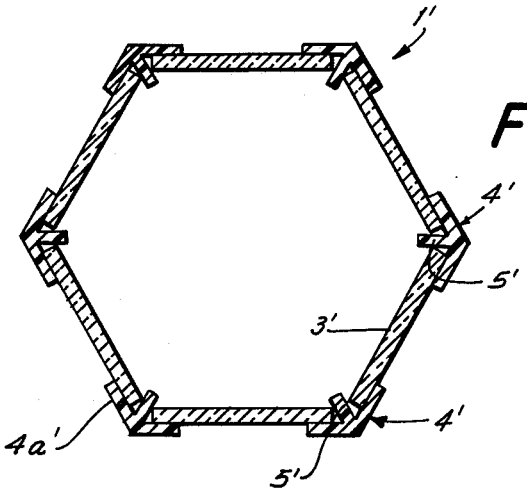
FIG. 6 is a horizontal sectional view of a frame forming part of a modified light fixture.

FIG. 6 shows a modified frame 1' wherein all such parts which are identical with or clearly analogous to corresponding parts of the frame 1 are denoted by similar reference characters each followed by a prime. The frame 1' is hexagonal and thus comprises six corner sections 4' for six panes 3'. The angle between the legs *4a'* of each corner section 4' is an obtuse angle; however, the angle between each partition 5' and the respective legs *4a'* is still an acute angle.

The improved light fixture is susceptible of many additional modifications without departing from the spirit of the invention. For example, the frame may constitute a truncated pyramid with an odd number of sides which may exceed or may be less than the number of sides of the illustrated frames, the fixture can be mounted upside down (e.g., suspended from the ceiling of a veranda) or mounted on a wall by means of a suitable bracket which is connected to the end wall 8 or to the cover 2. Still further, all of the panes need not transmit light, the panes may be provided with identical or different types of ornamentation, the panes may be multicolored, and the light-transmissivity of panes may vary from pane to pane.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A light fixture, comprising a one-piece hollow truncated pyramidal frame with an open base, said frame including an end wall located opposite said base and elongated sloping corner sections extending from said base to said end wall, each of said sections including two legs and a partition extending into the interior of said frame, disposed between and making an acute angle with each of said legs, said frame having a plurality of first ventilating openings in the region of said end wall; a discrete light-transmitting pane for each of said corner sections, said panes being located in the interior of said frame between neighboring corner sections and each having two sloping marginal portions, one of which sealingly engages one leg and abuts against the partition of one of the neighboring sections and the other of which sealingly engages one leg and abuts against the partition of the other neighboring section; and a one-piece cover overlying said base, said fixture having a plurality of second ventilating openings in the region of said cover and each of said first and second openings being sufficiently small to prevent insects, particularly nocturnal insects, from entering the interior of the fixture.

2. A fixture as defined in claim 1, wherein said frame and said cover consist of synthetic plastic material.

3. A fixture as defined in claim 1, wherein said first openings are provided in said end wall.

4. A fixture as defined in claim 1, wherein said end wall includes at least one screen having interstices which constitute said first openings.

5. A fixture as defined in claim 1, wherein said frame further comprises a circumferentially complete polygonal section surrounding said base, said section and said cover having abutting first and second surfaces and one of said surfaces having notches constituting said second openings.

6. A fixture as defined in claim 1, wherein said cover is a hipped roof.

7. A fixture as defined in claim 1, wherein said frame further comprises a first circumferentially complete polygonal section surrounding said end wall and a second circumferentially complete polygonal section surrounding said base and abutting against said cover, said corner sections extending between said first and second polygonal sections.

8. A fixture as defined in claim 1, wherein said base is located at a level above said end wall, and further comprising a support disposed below and rigid with said end wall.

9. A fixture as defined in claim 1, wherein said first openings form several groups of openings in said end wall of said frame.

10. A fixture as defined in claim 1, wherein said second openings surround said base.

* * * * *